US009835979B2

(12) United States Patent
Suenami

(10) Patent No.: US 9,835,979 B2
(45) Date of Patent: Dec. 5, 2017

(54) DEVELOPING DEVICE AND IMAGE FORMING APPARATUS THEREWITH

(71) Applicant: KYOCERA Document Solutions Inc., Osaka (JP)

(72) Inventor: Koji Suenami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/229,860

(22) Filed: Aug. 5, 2016

(65) Prior Publication Data

US 2017/0068185 A1 Mar. 9, 2017

(30) Foreign Application Priority Data

Sep. 8, 2015 (JP) ..... 2015-176805

(51) Int. Cl.
*G03G 15/08* (2006.01)

(52) U.S. Cl.
CPC ... *G03G 15/0893* (2013.01); *G03G 2215/083* (2013.01); *G03G 2215/0833* (2013.01)

(58) Field of Classification Search
CPC ..... G03G 2215/083; G03G 2215/0833; G03G 2215/0838; G03G 2215/0827
See application file for complete search history.

(56) References Cited

U.S. PATENT DOCUMENTS

2011/0229213 A1* 9/2011 Mihara ..... G03G 15/0875 399/263
2012/0177412 A1* 7/2012 Watanabe ..... G03G 15/0189 399/256

FOREIGN PATENT DOCUMENTS

JP 2001-265098 A 9/2001

* cited by examiner

*Primary Examiner* — Victor Verbitsky
(74) *Attorney, Agent, or Firm* — Stein IP, LLC

(57) ABSTRACT

A developing device includes a developing container, a first stirring member, a second stirring member, and a developer discharge port. The developing container has a first and a second transport chamber. The first stirring member has a rotary shaft and a first helical blade. The second stirring member has a rotary shaft and a second helical blade. Through the developer discharge port, surplus developer inside the developing container is discharged. On the second stirring member, a restricting portion for restricting movement of developer toward the developer discharge port is formed downstream of the second helical blade. The restricting portion has two or more turns of a restricting blade wound in the direction opposite to the second helical blade, and the restricting blade has an increasingly large outside diameter from upstream to downstream with respect to the developer transport direction inside the second transport chamber.

5 Claims, 4 Drawing Sheets

DEVELOPING DEVICE AND IMAGE FORMING APPARATUS THEREWITH

INCORPORATION BY REFERENCE

This application is based upon and claims the benefit of priority from the corresponding Japanese Patent Application No. 2015-176805 filed on Sep. 8, 2015, the entire contents of which are incorporated herein by reference.

BACKGROUND

The present disclosure relates to developing devices used in image forming apparatuses adopting an electrophotographic system, such as copiers, printers, facsimile machines, and multifunction peripherals having combined functions of those, and to image forming apparatuses provided with such developing devices. More particularly, the present disclosure relates to developing devices that, while being supplied with fresh two-component developer containing toner and carrier, discharge surplus developer, and to image forming apparatuses provided with such developing devices.

In an image forming apparatus, an electrostatic latent image formed on an image carrier comprising a photosensitive body or the like is developed by a developing device into a toner image so as to be made visible. There is a type of developing device that adopts a two-component development system using two-component developer. In this type of developing device, two-component developer containing carrier and toner is stored in a developing container, a developing roller for feeding the developer to the image carrier is arranged, and a stirring member for feeding, while stirring and transporting, the developer inside the developing container to the developing roller is arranged.

In this developing device, as toner is consumed in developing operation, carrier remains unconsumed inside the developing container. Thus, the carrier, which is stirred with the toner inside the developing container, deteriorates due to mechanical stress from being stirred repeatedly. As a result, the carrier's ability to electrostatically charge the toner gradually diminishes.

As a solution, there have been proposed developing devices in which, while fresh developer containing carrier and toner is supplied into a developing container, surplus developer is discharged with a view to suppressing a drop in electrostatic charging performance.

For example, in a known developing device, two stirring members each having a rotary shaft and a helical blade formed in a helical shape on its circumference are arranged parallel to each other in transport chambers respectively. The transport chambers are divided by a partition portion, and in opposite end parts of the partition portion, communicating portions for delivering developer are provided. A developer discharge port is formed downstream of one of the transport chambers with respect to the developer transport direction, and between the stirring member there and the developer discharge port, an opposite helical blade formed in a helical shape wound in the direction opposite to the helical blade on the stirring member is provided, as a restricting portion, integrally with the rotary shaft.

With this developing device, when developer is supplied into the developing container, as the stirring member rotates, the developer is, while being stirred, transported to downstream of the transport chamber. As the opposite helical blade rotates in the same direction as the stirring member, the opposite helical blade applies to the developer a transporting force that acts in the direction opposite to the direction of developer transport by the stirring member. With this opposite transporting force, on the downstream side of the transport chamber, developer is blocked to have an increased height. Thus, surplus developer passes over the opposite helical blade (restricting portion) to move to the developer discharge port, and is discharged. In this way, developer can be replaced while the height of the developer inside the developing container is kept substantially constant.

SUMMARY

According to one aspect of the present disclosure, a developing device includes a developing container, a first stirring member, a second stirring member, a developer carrier, a developer supply port, and a developer discharge port. The developing container has a plurality of transport chambers including a first transport chamber and a second transport chamber arranged side by side, and communicating portions through which the first and second transport chambers communicate with each other at opposite longitudinal-direction end parts thereof. The developing container stores two-component developer containing carrier and toner. The first stirring member is composed of a rotary shaft and a first helical blade formed on the circumferential face of the rotary shaft, and stirs and transports developer inside the first transport chamber in the rotary-shaft direction. The second stirring member is composed of a rotary shaft and a second helical blade formed on the circumferential face of the rotary shaft, and stirs and transports developer inside the second transport chamber in the direction opposite to the first stirring member. The developer carrier is rotatably supported on the developing container, and carries on the surface thereof the developer inside the second transport chamber. Through the developer supply port, developer is supplied into the developing container. The developer discharge port is provided in a downstream-side end part of the second transport chamber with respect to the developer transport direction inside the second transport chamber, and through it, surplus developer inside the developing container is discharged. On the second stirring member, a restricting portion which restricts the movement of developer toward the developer discharge port is formed so as to be opposed to the developer discharge port downstream of the second helical blade with respect to the developer transport direction inside the second transport chamber. The restricting portion is composed of two or more turns of a restricting blade wound in the direction opposite to the second helical blade. The second transport chamber has a uniform inside diameter in the part thereof opposed to the restricting blade. The restricting blade has an increasingly large outside diameter from upstream to downstream with respect to the developer transport direction inside the second transport chamber.

Further features and advantages of the present disclosure will become apparent from the description of embodiments given below.

DETAILED DESCRIPTION

Figure 1:
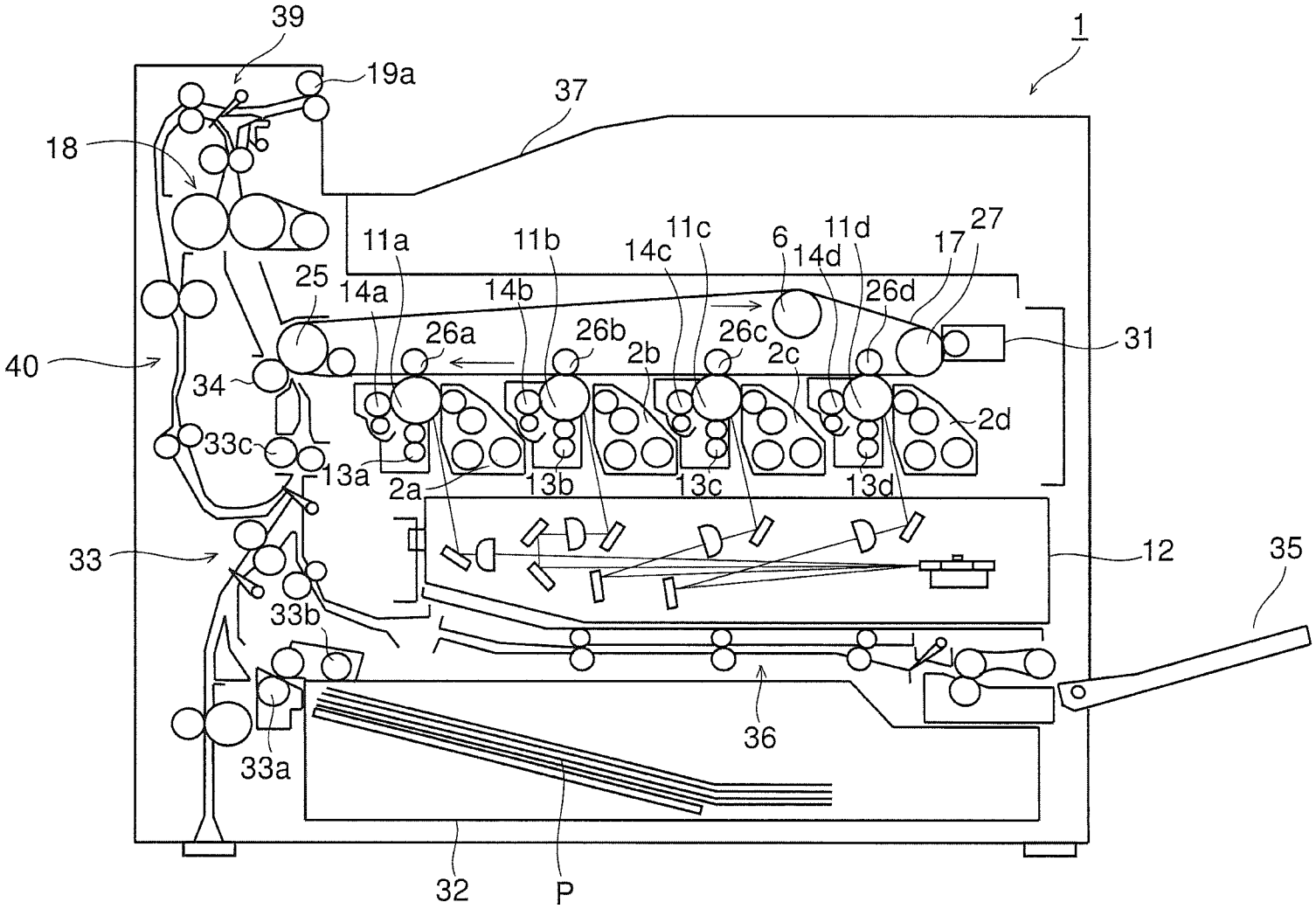
FIG. 1 is a sectional view schematically showing an overall construction of an image forming apparatus 1 incorporating developing devices 2*a* to 2*d* according to the present disclosure.

An embodiment of the present disclosure will be described below with reference to the accompanying drawings. FIG. 1 is a sectional view schematically showing a construction of an image forming apparatus 1 incorporating developing devices 2*a* to 2*d* according to the present disclosure. The image forming apparatus 1 is a tandem-type color printer. There are arranged rotatable photosensitive drums (image carriers) 11*a* to 11*d* that are, for example, organic photosensitive bodies (OPC photosensitive bodies) having an organic photosensitive layer formed on them or amorphous silicon photosensitive bodies having an amorphous silicon layer formed on them and that are arranged to correspond to different colors, namely black, yellow, cyan, and magenta. Around the photosensitive drums 11*a* to 11*d*, there are arranged developing devices 2*a* to 2*d*, an exposure unit 12, electrostatic chargers 13*a* to 13*d*, and cleaning devices 14*a* to 14*d*.

The developing devices 2*a* to 2*d* are arranged beside (to the right of) the photosensitive drums 11*a* to 11*d*, respectively, so as to be opposed to them, and feed toner to the photosensitive drums 11*a* to 11*d*. The electrostatic chargers 13*a* to 13*d* are arranged upstream of the developing devices 2*a* to 2*d* with respect to the rotation direction of the photosensitive drums 11*a* to 11*d* (in FIG. 1, the counterclockwise direction) so as to be opposed to the surfaces of the photosensitive drums 11*a* to 11*d*, and electrostatically charge the surfaces of the photosensitive drums 11*a* to 11*d* uniformly.

The exposure unit 12 scans the photosensitive drums 11*a* to 11*d* to expose them to light based on image data, conveying characters and figures, fed to an image input portion (unillustrated) from a personal computer or the like, and is arranged under the developing devices 2*a* to 2*d*. Inside the exposure unit 12, there are arranged a laser light source and a polygon mirror, and there are also arranged reflective mirrors and lenses to correspond to the photosensitive drums 11*a* to 11*d*. The laser light emitted from the laser light source is shone, via the polygon mirror, reflective mirrors, and lenses, onto the surfaces of the photosensitive drums 11*a* to 11*d* from downstream of the electrostatic chargers 13*a* to 13*d* with respect to the rotation direction of the photosensitive drums 11*a* to 11*d*. The laser light thus shone forms electrostatic latent images on the surfaces of the photosensitive drums 11*a* to 11*d*, and these electrostatic latent images are developed into toner images by the developing devices 2*a* to 2*d*.

An endless intermediary transfer belt 17 is wound around a tension roller 6, a driving roller 25, and a following roller 27. The driving roller 25 is driven to rotate by an unillustrated motor, and as the driving roller 25 rotates, the intermediary transfer belt 17 is driven to circulate in the clockwise direction in FIG. 1.

The photosensitive drums 11*a* to 11*d* are arranged next to each other along the belt movement direction (the direction indicated by arrows in FIG. 1) under the intermediary transfer belt 17 so as to remain in contact with the intermediary transfer belt 17. Primary transfer rollers 26*a* to 26*d* are arranged so as to be opposed to the photosensitive drums 11*a* to 11*d* respectively across the intermediary transfer belt 17, and are kept in pressed contact with the intermediary transfer belt 17 to form a primary transfer portion. At this primary transfer portion, as the intermediary transfer belt 17 rotates, the toner images on the photosensitive drums 11*a* to 11*d* are successively transferred to the intermediary transfer belt 17 with predetermined timing. As a result, on the surface of the intermediary transfer belt 17, a full-color toner image is formed that has toner images of four colors, namely cyan, magenta, yellow, and black, superimposed together.

A secondary transfer roller 34 is opposed to the driving roller 25 across the intermediary transfer belt 17, and is kept in pressed contact with the intermediary transfer belt 17 to form a secondary transfer portion. At this secondary transfer portion, the toner image on the surface of the intermediary transfer belt 17 is transferred to a paper or other sheet P. After the transfer, a belt cleaning device 31 clears the surface of the intermediary transfer belt 17 of toner that is left unused.

In a lower part inside the image forming apparatus 1, a sheet feed cassette 32 for storing sheets P is arranged, and to the right of the sheet feed cassette 32, a stack tray 35 for manual feeding of sheets is arranged. To the left of the sheet feed cassette 32, there is arranged a first sheet transfer passage 33 through which a sheet P fed out of the sheet feed cassette 32 is transferred to the secondary transfer portion on the intermediary transfer belt 17. To the left of the stack tray 35, there is arranged a second sheet transfer passage 36 through which a sheet fed out of the stack tray 35 is transported to the secondary transfer portion. Furthermore, in an upper left part of the image forming apparatus 1, there are arranged a fixing portion 18 which performs fixing operation on a sheet P having an image formed on it and a third sheet transport passage 39 through which a sheet having undergone fixing operation is transported to a sheet discharge portion 37.

The sheet feed cassette 32, when drawn out of the apparatus (toward the near side in FIG. 1), can be replenished with sheets, and feeds out sheets P stored in it into the first sheet transfer passage 33, one sheet after another, by the action of a pickup roller 33*b* and a separating roller 33*a*.

The first sheet transfer passage 33 and the second sheet transfer passage 36 meet just downstream of a registration roller pair 33*c*, and by the registration roller pair 33*c*, a sheet P is transported to the secondary transfer portion with appropriate timing with regard to image forming operation on the intermediary transfer belt 17 and sheet feeding operation. The sheet P thus transported to the secondary transfer portion then has the full-color toner image on the intermediary transfer belt 17 secondarily transferred to it by a secondary transfer roller 34 to which a bias potential is applied, and is then transported to the fixing portion 18.

The fixing portion 18 includes, among others, a fixing belt which is heated by a heating roller, a fixing roller which is kept in contact with the fixing belt from inside, and a pressing roller which is arranged in pressed contact with the fixing roller, and performs fixing operation by applying heat and pressure to the sheet P having the toner image transferred to it. After the fixing of the toner image by the fixing portion 18, the sheet P is, as necessary, reversed in a fourth sheet transport passage 40 so that a toner image is secondarily transferred to the reverse side of the sheet as well and is fixed in the fixing portion 18. The sheet having the toner image or images fixed to it passes through the third sheet transport passage 39, and is discharged onto the sheet discharge portion 37 by discharge rollers 19*a*.

Figure 2:
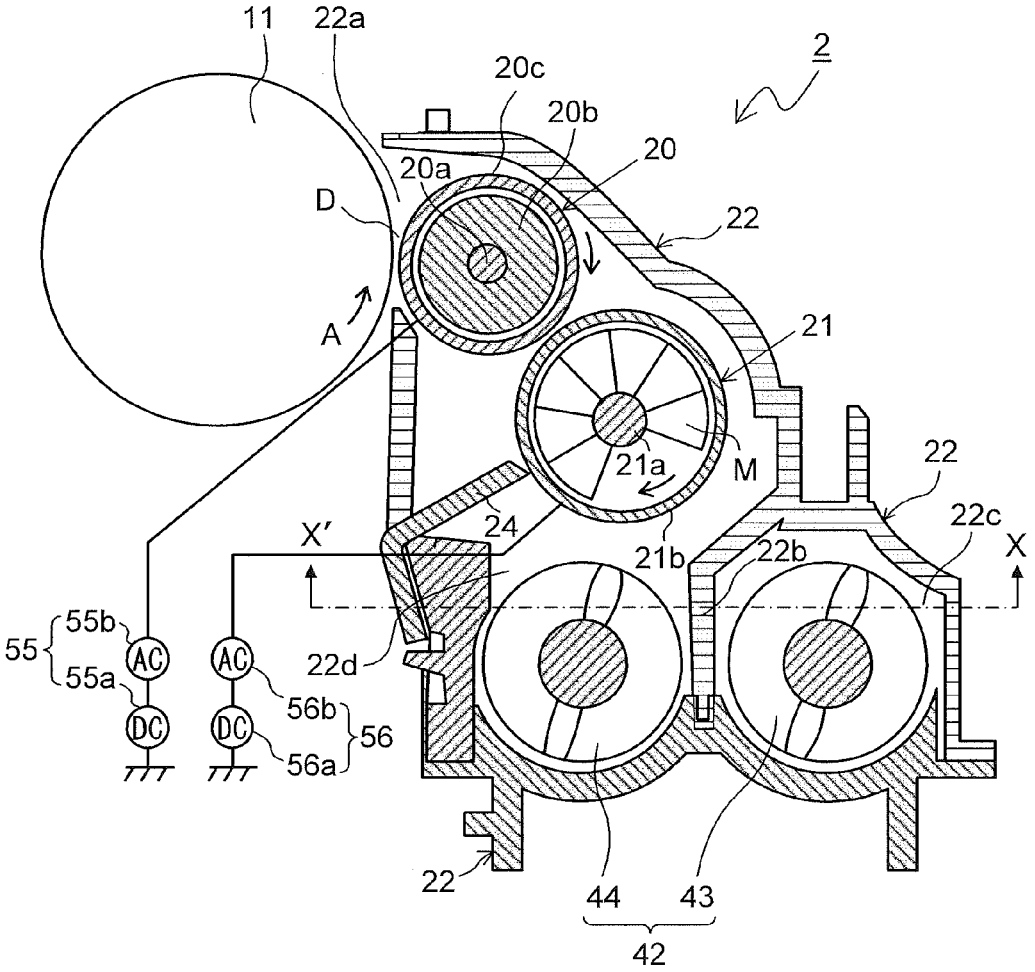
FIG. 2 is a side sectional view of a developing device 2 according to one embodiment of the present disclosure.

FIG. 2 is a side sectional view showing a construction of a developing device 2 that is used in the image forming apparatus 1 described above. The following description deals with the construction and operation of the developing device 2*a* corresponding to the photosensitive drum 11*a* shown in FIG. 1. Since the construction and operation of the developing devices 2*b* to 2*d* are similar to those of the developing device 2*a*, no overlapping description will be repeated, and the suffixes "a" to "d" distinguishing the developing devices and the photosensitive bodies for different colors will be omitted.

As shown in FIG. 2, the developing device 2 is composed of a developing roller 20, a magnetic roller (developer carrier) 21, a restricting blade 24, stirring members 42, a developing container 22, etc.

The developing container 22 forms a casing of the developing device 2, and a lower part of the developing container 22 is divided into a first transport chamber 22*c* and a second transport chamber 22*d* by a partition portion 22*b*. In the first and second transport chambers 22*c* and 22*d*, developer containing carrier and toner (here, positive-charge toner) is stored. The developing container 22 rotatably holds the stirring members 42, the magnetic roller 21, and the developing roller 20. The developing device 2 has an opening 22*a* formed in it through which the developing roller 20 is exposed toward the photosensitive drum 11.

The developing roller 20 is opposed to the photosensitive drum 11, and is arranged to the right of the photosensitive drum 11 across a predetermined distance. In the developing roller 20, at a position close to and opposed to the photosensitive drum 11, a developing region D is formed through in toner is fed to the photosensitive drum 11. The magnetic roller 21 is opposed to the developing roller 20 across a predetermined distance, and is arranged obliquely to the lower right of the developing roller 20. At a position close to and opposed to the developing roller 20, the magnetic roller 21 feeds toner to the developing roller 20. The stirring members 42 are arranged substantially under the magnetic roller 21. The restricting blade 24 is fixedly held by the developing container 22 obliquely to the lower left of the magnetic roller 21.

The stirring member 42 is composed of two members, namely a first spiral (first stirring member) 43 and a second spiral (second stirring member) 44. The second spiral 44 is arranged under the magnetic roller 21, inside the second transport chamber 22*d*, and the stirring member 42 is arranged next to, to the right of, the second spiral 44, inside the first transport chamber 22*c*.

The first and second spirals 43 and 44 stir developer to electrostatically charge the toner in the developer to a predetermined level. This permits the toner to be held by the carrier. In opposite end parts of the partition portion 22*b*, which divides between the first and second transport chambers 22*c* and 22*d*, in its longitudinal direction (in FIG. 2, the direction perpendicular to the plane of the figure), communicating portions (unillustrated) are provided; thus, as the first spiral 43 rotates, electrostatically charged developer is transported to the second spiral 44 via one of the communicating portions formed in the partition portion 22*b* so that the developer circulates through the first and second transport chambers 22*c* and 22*d*. The developer is then fed from the second spiral 44 to the magnetic roller 21.

The magnetic roller 21 includes a magnetic pole member M and a non-magnetic sleeve 21*b* formed of a non-magnetic material, carries developer fed from the stirring member 42, and feeds, out of the developer it carries, only the toner to the developing roller 20. In the magnetic pole member M, a plurality of magnets having a fan-shaped cross-section and having different polarities in circumferential parts are arranged alternately, and are fixed to a roller shaft 21*a* with adhesive or otherwise. The roller shaft 21*a* is, inside the non-magnetic sleeve 21*b*, non-rotatably supported on the developing container 22, with a predetermined distance secured between the magnetic pole member M and the non-magnetic sleeve 21*b*. The non-magnetic sleeve 21*b* rotates in the same direction (in FIG. 2, the clockwise direction) as the developing roller 20 by being driven by an unillustrated driving mechanism composed of a motor and gears, and a bias 56 that has an alternating-current voltage 56*b* superposed on a direct-current voltage 56*a* is applied to the non-magnetic sleeve 21*b*. On the surface of the non-magnetic sleeve 21*b*, electrostatically charged developer is carried while forming a magnetic brush under the magnetic force of the magnetic pole member M, and the height of the magnetic brush is adjusted to a predetermined height by the restricting blade 24.

As the non-magnetic sleeve 21*b* rotates, the magnetic brush is transported while being carried on the surface of the non-magnetic sleeve 21*b* by the magnetic pole member M; when it makes contact with the developing roller 20, out of the magnetic brush, only the toner is fed to the developing roller 20 in accordance with the bias 56 applied to the non-magnetic sleeve 21*b*.

The developing roller 20 is composed of, among others, a fixed shaft 20*a*, a magnetic pole member 20*b*, and a developing sleeve 20*c* formed of a non-magnetic metal material in a cylindrical shape.

The fixed shaft 20*a* is non-rotatably supported on the developing container 22. On the fixed shaft 20*a*, the developing sleeve 20*c* is rotatably held, and the magnetic pole member 20*b*, which is formed of magnets, is fixed with adhesive or otherwise, at a position opposed to the magnetic roller 21, with a predetermined distance secured from the developing sleeve 20*c*. The developing sleeve 20*c* is rotated in the direction indicated by an arrow in FIG. 2 (the clockwise direction) by an unillustrated mechanism composed of a motor and gears. A developing bias 55 that has an alternating-current voltage 55*b* superposed on a direct-current voltage 55*a* is applied to the developing sleeve 20*c*.

As the developing sleeve 20*c* having the developing bias 55 applied to it rotates in the clockwise direction in FIG. 2, in the developing region D, a potential difference between the developing bias potential and the potential in the exposed part of the photosensitive drum 11 causes the toner carried on the surface of the developing sleeve 20*c* to fly to the photosensitive drum 11. The toner thus flown attaches to the exposed part of the photosensitive drum 11 rotating in the direction indicated by arrow A (the counter-clockwise direction), and thereby an electrostatic latent image on the photosensitive drum 11 is developed.

Figure 3:
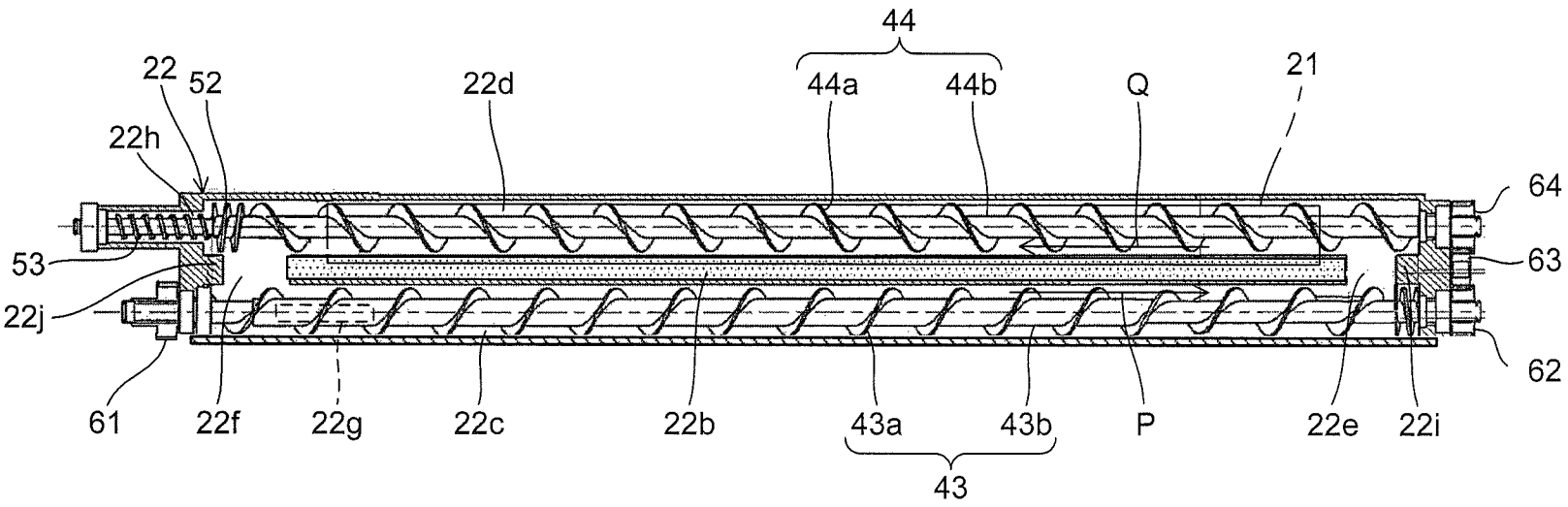
FIG. 3 is a sectional plan view of a stirring portion in the developing device 2 according to the embodiment.

Next, with reference to FIG. 3, a stirring portion in the developing device 2 will be described in detail. FIG. 3 is a sectional plan view (sectional view across line X-X' in FIG. 2 as seen from the direction indicated by arrows) showing the stirring portion in the developing device 2.

As mentioned above, inside the developing container 22, there are formed a first transport chamber 22*c*, a second transport chamber 22*d*, a partition portion 22*b*, an upstream-side communicating portion 22*e*, and a downstream-side communicating portion 22*f*, and there are further formed a developer supply port 22*g*, a developer discharge port 22*h*, an upstream-side wall portion 22*i*, and a downstream-side wall portion 22*j*. Of the first transport chamber 22*c*, the left side in FIG. 3 are referred to as the upstream side, and the right side in FIG. 3 as the downstream side. Of the second transport chamber 22*d*, the right side in FIG. 3 are referred to as the upstream side, and the left side in FIG. 3 as the downstream side. Accordingly, with respect to the second transport chamber 22*d*, the communicating portions are each referred to as either an upstream-side or downstream-side communicating portion, and the side wall portions are each referred to as either an upstream-side or downstream-side wall portion.

The partition portion 22*b* extends in the longitudinal direction of the developing container 22 to divide between the first and second transport chambers 22*c* and 22*d* such that these lie side by side. A right end part of the partition portion 22*b* in its longitudinal direction forms, together with an inner wall part of the upstream-side wall portion 22*i*, the upstream-side communicating portion 22*e*; on the other hand, a left end part of the partition portion 22*b* in its longitudinal direction forms, together with an inner wall part of the downstream-side wall portion 22*j*, the downstream-side communicating portion 22*f*. Thus, the developer can circulate through the first transport chamber 22*c*, the upstream-side communicating portion 22*e*, the second transport chamber 22*d*, and the downstream-side communicating portion 22*f*.

The developer supply port 22*g* is an opening through which fresh toner and carrier are supplied from a developer supply container (unillustrated) provided over the developing container 22, and is arranged in an upstream-side (in FIG. 3, left-side) part of the first transport chamber 22*c*.

The developer discharge port 22*h* is an opening through which, as fresh developer is supplied, surplus developer inside the first and second transport chambers 22*c* and 22*d* is discharged, and is provided in a downstream-side part of the second transport chamber 22*d* so as to be continuous with the second transport chamber 22*d* in its longitudinal direction.

Inside the first transport chamber 22*c*, the first spiral 43 is arranged, and inside the second transport chamber 22*d*, the second spiral 44 is arranged.

The first spiral 43 has a rotary shaft 43*b* and a first helical blade 43*a* that is formed integrally with the rotary shaft 43*b* and that has a helical shape with a predetermined pitch in the axial direction of the rotary shaft 43*b*. The first helical blade 43*a* extends up to opposite end parts of the first transport chamber 22*c* in its longitudinal direction so as to be opposed to the upstream- and downstream-side communicating portions 22*e* and 22*f*. The rotary shaft 43*b* is rotatably pivoted on the upstream- and downstream-side wall portions 22*i* and 22*j*.

The second spiral 44 has a rotary shaft 44*b* and a second helical blade 44*a* that is formed integrally with the rotary shaft 44*b* and that has a helical shape with a blade wound with the same pitch as but in the opposite direction (with the opposite phase) to the first helical blade 43*a* in the axial direction of the rotary shaft 44*b*. The second helical blade 44*a* has a length that is larger than the length of the magnetic roller 21 in its axial direction, and extends to reach a position opposed to the upstream-side communicating portion 22*e*. The rotary shaft 44*b* is arranged parallel to the rotary shaft 43*b*, and is rotatably pivoted on the upstream- and downstream-side wall portions 22*i* and 22*j* of the developing container 22.

On the rotary shaft 44*b*, there are integrally arranged, in addition to the second helical blade 44*a*, a restricting portion 52 and a discharge blade 53.

The restricting portion 52 blocks the developer transported downstream inside the second transport chamber 22*d*, but allows the developer exceeding a predetermined amount to be transported to the developer discharge port 22*h*. The restricting portion 52 comprises a helical blade (restricting blade) formed on the rotary shaft 44*b*, and has a helical shape with a blade wound in the opposite direction (with the opposite phase) to, and with a smaller pitch than, the second helical blade 44*a*. The circumferential part of the restricting portion 52 has a predetermined distance (clearance) from the inner wall part of the developing container 22. Through this gap, surplus developer is discharged.

The rotary shaft 44*b* extends to reach inside the developer discharge port 22*h*. On a part of the rotary shaft 44*b* inside the developer discharge port 22*h*, the discharge blade 53 is provided. The discharge blade 53 comprises a blade in a helical shape wound in the same direction as the second helical blade 44*a*, but has a smaller pitch than the second helical blade 44*a*, and the blade has a smaller circumference. Accordingly, as the rotary shaft 44*b* rotates, the discharge blade 53 rotates together so that the surplus developer that has been transported into the developer discharge port 22*h* over the restricting portion 52 is transported leftward in FIG. 3 to be discharged out of the developing container 22. The discharge blade 53, the restricting portion 52, and the second helical blade 44*a* are formed of synthetic resin integrally with the rotary shaft 44*b*.

On the outer wall of the developing container 22, gears 61 to 64 are arranged. The gears 61 and 62 are fixed to the rotary shaft 43*b*, the gear 64 is fixed to the rotary shaft 44*b*, and the gear 63 is rotatably held on the developing container 22 and meshes with the gears 62 and 64.

During development in which no fresh developer is supplied, as the gear 61 is rotated by a driving source such as a motor, the first helical blade 43*a* rotates together with the rotary shaft 43*b*; thus, by the first helical blade 43*a*, developer is transported in the direction indicated by arrow P inside the first transport chamber 22*c*, and is then transported through the upstream-side communicating portion 22*e* into the second transport chamber 22*d*. Then, as the second helical blade 44*a* rotates together with the rotary shaft 44*b* which is interlocked with the gear 64, by the second helical blade 44*a*, developer is transported in the direction indicated by arrow Q inside the second transport chamber 22*d*. Thus, developer is, while greatly changing its height, transported from the first transport chamber 22*c* through the upstream-side communicating portion 22*e* into the second transport chamber 22*d*, and is transported through the downstream-side communicating portion 22*f* into the first transport chamber 22*c* without passing over the restricting portion 52.

As described above, as developer circulates through the first transport chamber 22*c*, the upstream-side communicating portion 22*e*, the second transport chamber 22*d*, and the downstream-side communicating portion 22*f*, it is stirred, and the stirred developer is fed to the magnetic roller 21.

Next, a description will be given of a case where developer is supplied through the developer supply port 22*g*. As development progresses and toner is consumed, developer containing toner and carrier is supplied into the first transport chamber 22*c* through the developer supply port 22*g*.

As during development, by the first helical blade 43*a*, the supplied developer is transported in the direction indicated by arrow P inside the first transport chamber 22*c*, and is then transported through the upstream-side communicating portion 22*e* into the second transport chamber 22*d*. Then, by the second helical blade 44*a*, the developer is transported in the direction indicated by arrow Q inside the second transport chamber 22*d*. As the rotary shaft 44*b* rotates and thus the restricting portion 52 rotates together, the restricting portion 52 applies to the developer a transporting force that acts in the direction opposite to the direction of developer transport by the second helical blade 44*a*. The restricting portion 52 thus blocks the developer and increases its height; as a result, surplus developer passes over the restricting portion 52, and is discharged through the developer discharge port 22*h* out of the developing container 22.

Figure 4:
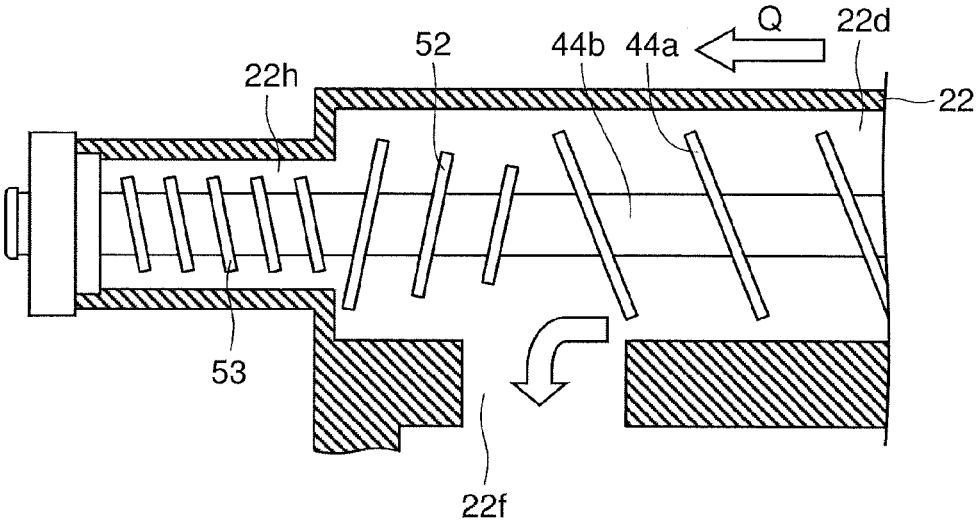
FIG. 4 is an enlarged view around a developer discharge port 22*h* in the developing device 2 according to the embodiment.
Figure 5:
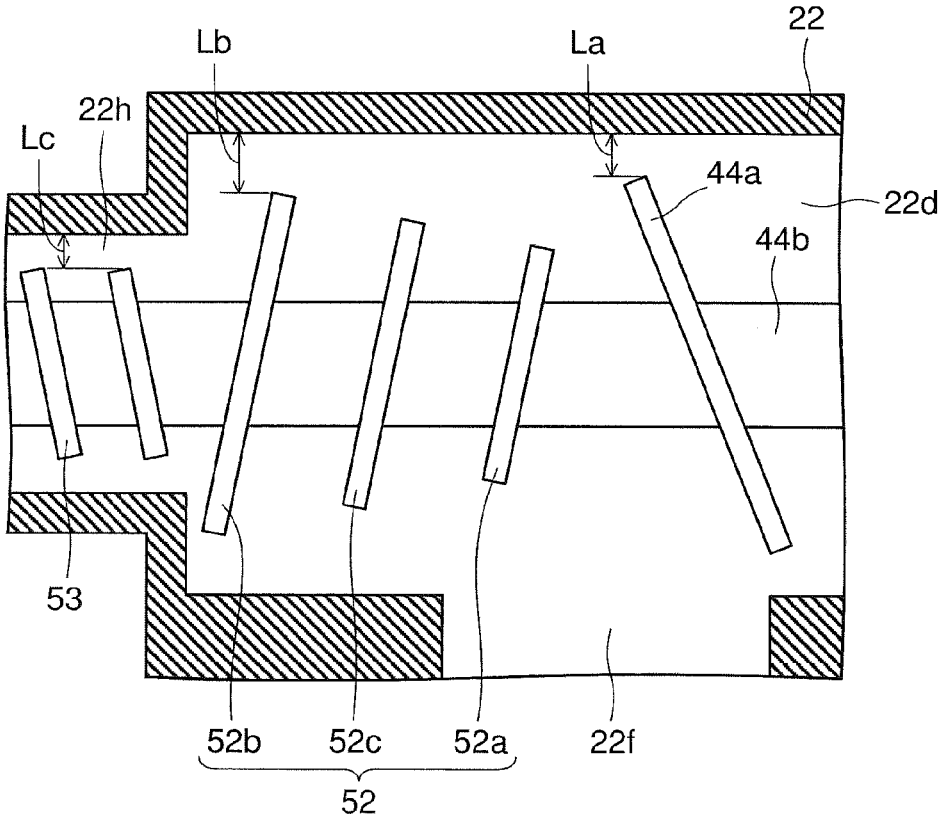
FIG. 5 is an enlarged view around the regulating portion 52 in FIG. 4.

FIG. 4 is an enlarged view around the developer discharge port 22*h* in the developing device 2 according to the embodiment, and FIG. 5 is an enlarged view around the restricting portion 52 in FIG. 4. As shown in FIGS. 4 and 5, the restricting portion 52 is composed of one turn of an upstream-side restricting blade 52*a* which is located at the most upstream-side position with respect to the developer transport direction and which adjoins the second helical blade 44*a*, a one turn of a downstream-side restricting blade 52*b* which is located at the most downstream-side position with respect to the developer transport direction and which adjoins the discharge blade 53, and a one turn of a middle restricting blade 52*c* which is arranged between the upstream-side restricting blade 52*a* and the downstream-side restricting blade 52*b*.

The outside diameter of the middle restricting blade 52*c* is larger than the outside diameter of the upstream-side restricting blade 52*a*, and the outside diameter of the downstream-side restricting blade 52*b* is larger than the outside diameter of the middle restricting blade 52*c*. That is, the restricting portion 52 has a stepwise increasing outside diameter from upstream to downstream with respect to the developer transport direction inside the second transport chamber 22*d*. The outside diameter of the upstream-side restricting blade 52*a* is equal to or larger than the outside diameter of the discharge blade 53. The outside diameter of the downstream-side restricting blade 52*b* is equal to or smaller than the outside diameter of the second helical blade 44*a*.

The inside diameter of the second transport chamber 22*d* is uniform. Thus, the inside diameter of the part of the second transport chamber 22*d* opposed to the second helical blade 44*a* and that of the part of the second transport chamber 22*d* opposed to the restricting portion 52 are equal.

With the construction described above, when the distance (clearance) between the second helical blade 44*a* and the inner wall face of the second transport chamber 22*d* is represented by La, and the distance (clearance) between the downstream-side restricting blade 52*b* and the inner wall face of the second transport chamber 22*d* is represented by Lb, the relationship Lb≥La is fulfilled. When the distance (clearance) between the discharge blade 53 and the inner wall face of the developer discharge port 22*h* is represented by Lc, the relationship Lb≥Lc is fulfilled.

Owing to the outside diameter of the upstream-side restricting blade 52*a* being smaller than the outside diameter of the downstream-side restricting blade 52*b*, the upstream-side restricting blade 52*a* exerts a weaker restricting force on the developer that has been transported through the second transport chamber 22*d* by the second helical blade 44*a*. As a result, while the developer continues to be transported in the main developer transport direction (the direction indicated by arrow Q), the transport speed drops; thus, the developer stagnates and thereby suppresses ruffling (fluctuation) on the surface of the developer moving toward the developer discharge port 22*h* and the downstream-side communicating portion 22*f*. Thus, the upstream-side restricting blade 52*a* serves to slacken the flow of developer in the restricting portion 52.

Owing to the outside diameter of the downstream-side restricting blade 52*b* being larger than the outside diameter of the upstream-side restricting blade 52*a*, the developer that has been transported through the second transport chamber 22*d* is acted on by a strong restricting force exerted by the downstream-side restricting blade 52*b*. As a result, the developer is acted on by a transporting force that acts in the direction opposite to the main transport direction. Thus, by applying the opposite transporting force to the developer whose flow has been slackened by the upstream-side restricting blade 52*a*, the downstream-side restricting blade 52*b* serves to increase the height of the developer in the restricting portion 52 and thereby adjust the amount of developer fed to the developer discharge port 22*h* over the downstream-side restricting blade 52*b* (i.e., the amount of developer discharged).

In the embodiment, as described above, the restricting portion 52 has an increasingly large outside diameter from upstream to downstream with respect to the developer transport direction inside the second transport chamber 22*d*. That is, the outside diameter of the upstream-side restricting blade 52*a* is smaller than the outside diameters of the middle regulating blade 52*c* and the downstream-side restricting blade 52*b*. Thus, even when the transport speed of developer is low (the stirring speed is low) or the fluidity of developer is low (the toner concentration is high, or the absolute humidity is high), it is possible to alleviate the difficulty of developer reaching the downstream-side restricting blade 52*b*, and thus to alleviate the difficulty of developer being discharged to the developer discharge port 22*h*. Moreover, the outside diameter of the downstream-side restricting blade 52*b* is larger than outside diameters of the upstream-side restricting blade 52*a* and the middle restricting blade 52*c*. Thus, even when the transport speed of developer is high (the stirring speed is high) or the fluidity of developer is high (the toner concentration is low, or the absolute humidity is low), it is possible to reduce the ease with which developer is discharged to the developer discharge port 22*h*. As described above, it is possible to stabilize the amount of developer discharged to the developer discharge port 22*h* against changes in the transport condition of the developer in the developing container 22 resulting from variations in the fluidity of developer due to variations in environmental conditions (humidity), variations in the toner concentration during development, variations in the developer transport speed, etc. It is thus possible to obtain a developing device 2 that can suppress variation of the amount of developer inside the developing container 22 and that thus provides stable developing performance.

Moreover, as described above, the outside diameter of the downstream-side restricting blade 52*b* is equal to or smaller than the outside diameter of the second helical blade 44*a*. This helps alleviate the difficulty of developer being discharged to the developer discharge port 22*h*.

Moreover, as described above, the outside diameter of the upstream-side restricting blade 52*a* is equal to or larger than the outside diameter of the discharge blade 53. This helps prevent the upstream-side restricting blade 52*a* from having an excessively small outside diameter, and it is thus possible, when the fluidity of developer is high or the transport speed of developer is high, to prevent an excessive amount of developer from reaching the downstream-side restricting blade 52*b*.

Moreover, as described above, by fulfilling Lb≥La, it is possible to alleviate the difficulty of developer being discharged to the developer discharge port 22*h*.

Moreover, as described above, the restricting portion 52 is arranged between the upstream-side restricting blade 52*a* and the downstream-side restricting blade 52*b*, and includes a middle restricting blade 52*c* of which the outside diameter is larger than the outside diameter of the upstream-side regulating blade 52*a* but smaller than the outside diameter of the downstream-side restricting blade 52*b*. It is thus possible to gradually vary the transport speed of the developer moving from the upstream-side restricting blade 52*a* to the downstream-side restricting blade 52*b*.

Although the embodiment deals with a case where the restricting portion 52 is composed of three turns of an opposite helical blade, specifically an upstream-side restricting blade 52*a*, a downstream-side restricting blade 52*b*, a the middle restricting blade 52*c*, the restricting portion 52 may be composed of any number of turns of an opposite helical blade other than three, for example, two turns or four or more turns. Although the embodiment deals with a case where the restricting portion 52 has a stepwise increasing outside diameter from upstream to downstream with respect to the developer transport direction inside the second transport chamber 22*d*, it may instead have a gradually (continuously) increasing outside diameter from upstream to downstream with respect to the developer transport direction inside the second transport chamber 22*d*.

The present disclosure can be implemented in any manner other than specifically described by way of an embodiment above, and allows for many modifications without departing from the spirit of the present disclosure. For example, the application of the present disclosure is not limited to developing devices incorporating a magnetic roller 21 and a developing roller 20 as shown in FIG. 2; the present disclosure finds application in various developing devices that use two-component developer containing toner and carrier. For example, although the embodiment described above deals with a developing device adopting a two-axis transport system including, as a developer circulation passage inside the developing container 22, a first transport chamber 22*c* and a second transport chamber 22*d* that are arranged side by side, application is also possible to developing devices adopting a three-axis transport system including a collection transport chamber for collecting developer separated from the magnetic roller 21 for gathering it into the second transport chamber 22*d*.

The application of the present disclosure is not limited to tandem-type color printers like the one shown in FIG. 1; the present disclosure finds application in various image forming apparatuses adopting a two-component development system, such as digital or analog monochrome copiers, monochrome printers, color copiers, and facsimile machines. Now, the effects of the present disclosure will be described in more detail by way of a practical example.

With the developing device 2 described above, experiments were conducted to see how the amount of developer inside the developing container 22 changed when the restricting portion 52 had an increasingly large outside diameter from upstream to downstream with respect to the developer transport direction inside the second transport chamber 22*d*. The experiments were conducted in the black image formation portion that included the photosensitive drum 11*a* and the developing device 2*a*.

The experiments were conducted for each of Practical Example and Comparative Example. Practical Example incorporated a developing device 2 in which, as shown in FIGS. 4 and 5, the upstream-side restricting blade 52*a* had an outside diameter of 10 mm, the middle restricting blade 52*c* had an outside diameter of 11 mm, and the downstream-side restricting blade 52*b* had an outside diameter of 12 mm. Comparative Example incorporated a developing device 2 in which, the upstream-side restricting blade 52*a*, the middle restricting blade 52*c*, and the downstream-side restricting blade 52*b* all had an outside diameter of 12 mm. In Practical Example, the distance between the upstream-side restricting blade 52*a* and the inner wall face of the second transport chamber 22*d* was 3.5 mm, the distance between the middle restricting blade 52*c* and the inner wall face of the second transport chamber 22*d* was 3.0 mm, and the distance Lb between the downstream-side restricting blade 52*b* and the inner wall face of the second transport chamber 22*d* was 2.5 mm. In Comparative Example, the distances from the upstream-side restricting blade 52*a*, the middle restricting blade 52*c*, and the downstream-side restricting blade 52*b* to the inner wall face of the second transport chamber 22*d* all were 2.5 mm.

In the second spiral 44 used in both Practical Example and Comparative Example, the second helical blade 44*a* had an outside diameter of 14 mm and a pitch of 30 mm, and the distance La between the second helical blade 44*a* and the inner wall face of the second transport chamber 22*d* was 1.5 mm. The upstream-side restricting blade 52*a*, the middle restricting blade 52*c*, and the downstream-side restricting blade 52*b* had a pitch of 5 mm. The discharge blade 53 had an outside diameter of 8 mm and a pitch of 5 mm, and the distance Lc between the discharge blade 53 and the inner wall face of the developer discharge port 22*h* was 1.5 mm. 150 $cm^3$ of developer was stored in the developing container 22 (the first and second transport chambers 22*c* and 22*d*).

The reference conditions were as follows: the stirring speed (rotation speed) of the first spiral 43 and the second spiral 44 was 300 rpm; the toner concentration in the developer stored in the developing container 22 (the mass ratio of toner to carrier, T/C) was 10%; the absolute humidity was 10 $g/m^3$. With respect to these reference conditions, the stirring speed (rotation speed) of the first spiral 43 and the second spiral 44 was changed among three different levels of 200 rpm, 300 rpm, and 400 rpm; the toner concentration in the developer stored in the developing container 22 was changed among three different levels of 8%, 10% and 12%; the absolute humidity was changed among three level of 5 $g/m^3$, 10 $g/m^3$, and 20 $g/m^3$. Under these different conditions, the amount of developer (stable volume) inside the developing device 2 at the time that the discharge of developer from the developing container 22 ceased was measured. The results are shown in Tables 1, 2, and 3.

TABLE 1

| Stirring Speed (rpm) | Toner Concentration (%) | Absolute Humidity ($g/m^3$) | Stable Volume ($cm^3$) Practical Example | Stable Volume ($cm^3$) Comparative Example |
|---|---|---|---|---|
| 200 | 10 | 10 | 117 | 123 |
| 300 | 10 | 10 | 115 | 118 |
| 400 | 10 | 10 | 113 | 115 |

TABLE 2

| Stirring Speed (rpm) | Toner Concentration (%) | Absolute Humidity ($g/m^3$) | Stable Volume ($cm^3$) Practical Example | Stable Volume ($cm^3$) Comparative Example |
|---|---|---|---|---|
| 300 | 8 | 10 | 115 | 115 |
| 300 | 10 | 10 | 115 | 118 |
| 300 | 12 | 10 | 114 | 120 |

TABLE 3

| Stirring Speed (rpm) | Toner Concentration (%) | Absolute Humidity ($g/m^3$) | Stable Volume ($cm^3$) Practical Example | Stable Volume ($cm^3$) Comparative Example |
|---|---|---|---|---|
| 300 | 10 | 5 | 116 | 115 |
| 300 | 10 | 10 | 115 | 118 |
| 300 | 10 | 20 | 116 | 119 |

Table 1 reveals the following. With the developing device 2 of Practical Example, a change in the stirring speed from 200 rpm to 400 rpm brought a 4 $cm^3$ variation in the volume of the developer inside developing container 22. In contrast, with the developing device 2 of Comparative Example, the change brought a 8 $cm^3$ variation in the volume of the developer inside developing container 22.

Table 2 reveals the following. With the developing device 2 of Practical Example, a change in the toner concentration from 8% to 12% brought a 1 $cm^3$ variation in the volume of the developer inside developing container 22. In contrast, with the developing device 2 of Comparative Example, the change brought a 5 $cm^3$ variation in the volume of the developer inside developing container 22.

Table 3 reveals the following. With the developing device 2 of Practical Example, a change in the absolute humidity from 5 $g/m^3$ to 20 $g/m^3$ brought a 1 $cm^3$ variation in the volume of the developer inside developing container 22. In contrast, with the developing device 2 of Comparative Example, the change brought a 4 $cm^3$ variation in the volume of the developer inside developing container 22.

Based of the results above, it is confirmed that, in the developing device according to the present disclosure where the three turns of a restricting blade constituting the restricting portion 52 has an increasingly large outside diameter from upstream to downstream with respect to the developer transport direction, the stable volume of developer exhibits a stable transition irrespective of the stirring speed or the developer fluidity (toner concentration, absolute humidity) as compared with that in a conventional construction where the restricting blade has a uniform outside diameter. Thus, by use of the developing device according to the present disclosure, it is possible to obtain stable developing performance, and to effectively suppress image defects and unnecessary discharge of developer.

The comparison of Practical Example with Comparative Example shows that the stable volume of developer was slightly lower in the Practical Example than in the Comparative Example. This resulted from the restricting portion 52 having a smaller outside diameter on the upstream side (the upstream-side restricting blade 52*a*), and the stable volume of developer can be adjusted by modifying the outside diameter of or the number of turns in the restricting blade.

The present disclosure finds applications in developing devices used in image forming apparatuses adopting an electrophotographic system, such as copiers, printers, facsimile machines, and multifunction peripherals having combined functions of those, and in image forming apparatuses provided with such developing devices. More particularly, the present disclosure finds applications in developing devices that, while being supplied with fresh two-component developer containing toner and carrier, discharge surplus developer, and in image forming apparatuses provided with such developing devices.

What is claimed is:

1. A developing device comprising:

a developing container having a plurality of transport chambers including a first transport chamber and a second transport chamber arranged side by side and communicating portions through which the first and second transport chambers communicate with each other at opposite longitudinal-direction end parts thereof, the developing container storing two-component developer containing carrier and toner;

a first stirring member composed of a rotary shaft and a first helical blade formed on a circumferential face of the rotary shaft, the first stirring member stirring and transporting developer inside the first transport chamber in a rotary-shaft direction;

a second stirring member composed of a rotary shaft and a second helical blade formed on a circumferential face of the rotary shaft, the second stirring member stirring and transporting developer inside the second transport chamber in a direction opposite to the first stirring member;

a developer carrier rotatably supported on the developing container, the developer carrier carrying on a surface thereof the developer inside the second transport chamber;

a developer supply port through which developer is supplied into the developing container;

a developer discharge port through which surplus developer inside the developing container is discharged, the developer discharge port extending from a downstream-side end part of the second transport chamber with respect to a developer transport direction inside the second transport chamber; and a discharge blade transporting surplus developer, wherein an inside diameter of the second transport chamber is uniform and is larger than an inside diameter of the developer discharge port, the rotary shaft of the second stirring member extends to reach inside the developer discharge port, the discharge blade is wound in a same direction as the second helical blade, and is provided on a part of the rotary shaft of the second stirring member located inside the developer discharge port, on the second stirring member, a restricting portion is formed so as to be opposed to the developer discharge port downstream of the second helical blade with respect to the developer transport direction inside the second transport chamber, the restricting portion restricting movement of developer toward the developer discharge port, the restricting portion is provided inside the second transport chamber, and comprises two or more turns of a restricting blade wound in a direction opposite to the second helical blade, the restricting blade has an increasingly larger outside diameter from upstream to downstream with respect to the developer transport direction inside the second transport chamber, the restricting blade includes one turn of an upstream-side restricting blade located most upstream with respect to the developer transport direction inside the second transport chamber and one turn of a downstream-side restricting blade located most downstream with respect to the developer transport direction inside the second transport chamber, and an outside diameter of the upstream-side restricting blade is equal to or larger than an outside diameter of the discharge blade.

2. The developing device of claim 1, wherein the downstream-side restricting blade has an outside diameter equal to or smaller than an outside diameter of the second helical blade.

3. The developing device of claim 2, wherein when a distance between the second helical blade and an inner wall face of the second transport chamber is represented by La, and a distance between the downstream-side restricting blade and the inner wall face of the second transport chamber is represented by Lb, a relationship $Lb \geq La$ is fulfilled.

4. The developing device of claim 1, wherein the restricting blade further includes one turn of a middle restricting blade arranged between the upstream-side restricting blade and the downstream-side restricting blade, the middle restricting blade having an outside diameter larger than an outside diameter of the upstream-side restricting blade but smaller than an outside diameter of the downstream-side restricting blade.

5. An image forming apparatus comprising the developing device of claim 1.

* * * * *